US011434689B1

(12) United States Patent
Golla

(10) Patent No.: US 11,434,689 B1
(45) Date of Patent: Sep. 6, 2022

(54) STORM PROTECTION SYSTEM

(71) Applicant: Henry E. Golla, Palm Coast, FL (US)

(72) Inventor: Henry E. Golla, Palm Coast, FL (US)

( * ) Notice: Subject to any disclaimer, the term of this patent is extended or adjusted under 35 U.S.C. 154(b) by 41 days.

(21) Appl. No.: 17/237,434

(22) Filed: Apr. 22, 2021

(51) Int. Cl.
*E06B 9/01* (2006.01)
*E06B 9/00* (2006.01)

(52) U.S. Cl.
CPC ..... *E06B 9/01* (2013.01); *E06B 2009/005* (2013.01); *E06B 2009/015* (2013.01)

(58) Field of Classification Search
USPC ..... 52/202, 203
See application file for complete search history.

(56) References Cited

U.S. PATENT DOCUMENTS 2,025,161 A * 12/1935 Franklin ..... E06B 5/12 52/291
2,598,610 A * 5/1952 Satz ..... E06B 9/04 269/254 R
2,622,285 A * 12/1952 Roos ..... E06B 3/28 52/801.12
2,742,679 A 4/1956 Young
5,335,452 A * 8/1994 Taylor ..... E06B 5/12 49/463
5,595,233 A * 1/1997 Gower ..... E06B 9/00 160/183
5,673,883 A 10/1997 Figueroa, Jr.
5,911,660 A * 6/1999 Watson ..... E06B 9/02 52/586.1
5,918,430 A * 7/1999 Rowland ..... E06B 3/28 52/202
6,161,605 A * 12/2000 Pena ..... E06B 9/0638 160/90
6,263,625 B1 * 7/2001 LaPointe ..... E06B 9/02 52/509
D489,035 S * 4/2004 Butler ..... D12/401
6,907,710 B2 * 6/2005 Trundle ..... E06B 9/02 52/489.1
7,100,329 B2 9/2006 Pleasants
7,469,502 B1 * 12/2008 Steel ..... E06B 9/02 49/463

(Continued)

OTHER PUBLICATIONS

Website: https://stormstopper.com/ Original date unknown but believed to be early enough to qualify as prior art.

(Continued)

*Primary Examiner* — Joshua K Ihezie
(74) *Attorney, Agent, or Firm* — Cook Alex Ltd.

(57) ABSTRACT

A storm protection system for a window or door unit located in a wall opening and having an outer frame, the system including at least one protective panel fit within the outer frame and wall opening, at least one pair of brackets connected to the outer frame at opposing sides of the wall opening and spaced from the front surface of the panel a first distance, at least one force distribution body with at least one alignment structure on the front surface and spaced from the rear surface a second distance that is greater than the first distance, at least one elongated flexible restraint extending between and connected to the at least two brackets is received by the alignment structure and when tensioned forces the at least one force distribution body against the at least one panel which forces the at least one panel against the window or door unit.

20 Claims, 6 Drawing Sheets

(56) References Cited

U.S. PATENT DOCUMENTS

| | | | | |
|---|---|---|---|---|
| 7,584,579 | B1 * | 9/2009 | Everitt | E06B 9/04 160/90 |
| 7,997,036 | B1 | 8/2011 | Motosko et al. | |
| 8,490,346 | B2 * | 7/2013 | Wedren | E06B 9/00 52/203 |
| 8,850,776 | B1 * | 10/2014 | Dunn | E04G 23/0203 52/762 |
| 10,081,979 | B1 * | 9/2018 | Buonpane | E06B 9/24 |
| 10,900,219 | B1 * | 1/2021 | Goodwin | E06B 9/02 |
| 2004/0154242 | A1 | 8/2004 | Hudoba et al. | |
| 2006/0288646 | A1 * | 12/2006 | Pleasants | E06B 9/02 52/202 |
| 2007/0193137 | A1 * | 8/2007 | DeBoth | E06B 9/02 52/202 |
| 2008/0034671 | A1 * | 2/2008 | Harrington | E06B 9/00 52/2.25 |
| 2009/0136292 | A1 * | 5/2009 | Germain | F16B 21/12 403/294 |
| 2010/0281783 | A1 * | 11/2010 | Harrington | E06B 9/06 137/511 |
| 2014/0338263 | A1 * | 11/2014 | Huddleston | E05C 21/00 70/77 |

OTHER PUBLICATIONS

Website: www.USHurriGuard.com Original date unknown but believed to be early enough to qualify as prior art.

* cited by examiner

STORM PROTECTION SYSTEM

BACKGROUND OF THE INVENTION

Field of the Invention

The present invention generally relates to devices used to protect property from storm damage, and more particularly to a storm protection system for a window or door unit located in a wall opening and having an outer frame adjacent the wall opening.

Discussion of the Prior Art

In certain geographic locations, it may be common for very strong storms to occur periodically and in some instances multiple times in a single year. The most common of these storms are hurricanes, but others may be hail storms and the like. Such storms may unleash tremendous energy and destruction via high winds and torrential rains.

Wall structures tend to provide robust protection for the interior of a building, whether a commercial or residential structure. Such wall structures may be constructed in various ways and of various materials. It is common for wall structures to be constructed of poured concrete, concrete block, rock or other masonry, or wood or metal framing covered by various materials, typically in the form of sheathing and siding, stucco or brick. Windows and doors are placed in wall openings typically to permit access, sunlight, viewing and/or ventilation. In contrast to wall structures, windows and doors located in wall openings are far less strong and durable, and present areas that are susceptible to extreme damage. For instance, windows and doors commonly may include glass or other transparent or translucent materials, as well as seals for prevention of water or air intrusion under normal conditions, including less severe storms. Severe storms also have a tendency to arrive with relatively short notice and may pass within minutes, hours or days. They additionally may present large amounts of flying debris and water, which in some locations may include corrosive salt water.

These conditions present challenges to a property owner when in the path of an impending storm. Prior art devices for shielding windows and doors in a storm have tended to be relatively difficult and/or time consuming to install, often requiring multiple people and resulting in damage to the property. For example, cutting, lifting and nailing or otherwise affixing heavy plywood to the side of a building to cover an entire wall opening typically is difficult and time consuming. It requires skills not shared by the general population. It also is not a swift, one-person job, and is likely to leave nail holes or other damage to the building structure. Other apparatus may include having to pre-install dozens of threaded studs in the side of the building around the wall opening. Then, when a storm is expected, a corresponding cover having apertures around its perimeter may be positioned over the threaded studs and against the wall structure, and held in place by fasteners, such as wing nuts. However, this requires skilled installation of the threaded studs in a specific pattern matching the apertures in the cover, the ability to lift and locate the cover over the threaded studs, followed by installation of numerous wing nuts. This again may require multiple people and can present a unique challenge when subjected to stressed conditions. Such threaded studs and fasteners also are subject to corrosion, especially given the wear induced by repeated installation and removal.

Prior art shielding devices also have tended to be constructed of opaque materials, such as plywood, which may be desired in some circumstances, but which leaves the interior of the building eerily darkened and its occupants unable to assess the changing weather conditions. Some devices require a window to be opened, to permit the shielding device to be secured upon closing the window. This can present unique challenges when a storm is approaching and is not feasible for a fixed or picture window or if a window has been painted shut.

SUMMARY OF THE INVENTION

The purpose and advantages of the invention will be set forth in and apparent from the description and drawings that follow, as well as will be learned by practice of the claimed subject matter.

This disclosure generally provides examples of a storm protection system for a window or door unit located in a wall opening and having an outer frame adjacent the wall opening. The system for a particular window or door includes elements, such as at least one pair of brackets, which can be pre-installed and which may have a clean, attractive appearance, while being less susceptible to corrosion. A protective panel can be sized for use in advance, without concern for tight tolerances and will not require apertures or detailed alignment for installation. The panel also may be constructed of relatively light weight material that can be handled by one person. At least one force distribution body and an elongated flexible restraint, such as a strap, may be used to hold the protective panel within a wall opening to protect a window or door. The strap may be quickly and easily connected to the brackets, received by an alignment structure on the force distribution body, joined by a buckle and placed under tension so as to force the force distribution body against the protective panel, thereby holding the protective panel in a position that will protect the window or door unit. It will be appreciated that the force applied to the protective panel by a force distribution panel is dependent upon and increases with an increase in the tension of the one or more elongated flexible restraints received by the force distribution body.

The example storm protection systems illustrated herein show that such systems may be configured to accommodate many different window or door unit arrangements, while using similar components. In some instances, it may be appropriate to use more than one force distribution body with a particular elongated flexible restraint and/or to use a plurality of parallel elongated flexible restraints with a plurality of force distribution bodies and/or a plurality of perpendicular elongated flexible restraints with one or more force distribution bodies.

In a first aspect, this disclosure provides a storm protection system for a window or door unit located in a wall opening and having an outer frame adjacent the wall opening, the storm protection system including at least one protective panel having generally planar front and rear surfaces and being dimensioned to fit within the outer frame and wall opening while the rear surface contacts the window or door unit, at least one pair of brackets connected to the outer frame at opposing sides of the wall opening located along a first axis and spaced apart from the front surface of the at least one protective panel a first distance, at least one force distribution body having front and rear surfaces and being dimensioned to fit within the outer frame and wall opening, with at least one alignment structure on the front surface and being spaced apart from the rear surface a second distance, wherein the rear surface of the at least one force distribution body contacts the front surface of the at least one protective panel and the second distance is greater than the first distance, at least one elongated flexible restraint extending along the first axis between and connected to the at least two brackets, wherein the at least one elongated flexible restraint is received by the at least one alignment structure on the front surface of the at least one force distribution body, and wherein when tensioned the at least one elongated flexible restraint forces the at least one force distribution body against the at least one protective panel which forces the at least one protective panel against the window or door unit.

While the disclosure illustrates the invention in the context of certain examples of a storm protection system for a window or door unit located in a wall opening, it will be appreciated that the storm protection system may be adapted for use with various window and door units and wall openings.

It is to be understood that both the foregoing general description and the following detailed description are exemplary and provided for purposes of explanation only and are not restrictive of the subject matter claimed. Further features and objects of the present disclosure will become more fully apparent in the following description of the preferred embodiments and from the appended claims.

BRIEF DESCRIPTION OF THE DRAWINGS

In describing the preferred embodiments, reference is made to the accompanying drawing figures wherein like parts have like reference numerals, and wherein.

It should be understood that the figures are not to scale. While some mechanical details of a storm protection system for a window or door unit located in a wall opening, including additional plan and section views of the examples shown and of examples that may have alternative configurations have not been included, such details are considered to be within the comprehension of those of skill in the art in light of the present disclosure. It also should be understood that the present invention is not limited to the example embodiments illustrated.

DETAILED DESCRIPTION OF THE PREFERRED EMBODIMENT

For the following defined terms, these definitions shall be applied, unless a different definition is given in the claims or elsewhere in this disclosure. As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

Referring generally to FIGS. 1A-8B it will be appreciated that storm protection systems for a window or door unit located in a wall opening of the present disclosure generally may be embodied within numerous configurations. Indeed, while acknowledging that all of the example configurations of such systems need not be shown herein, examples are provided to better demonstrate that aspects of the invention are shared by a variety of configurations that are contemplated.

Figure 1A:
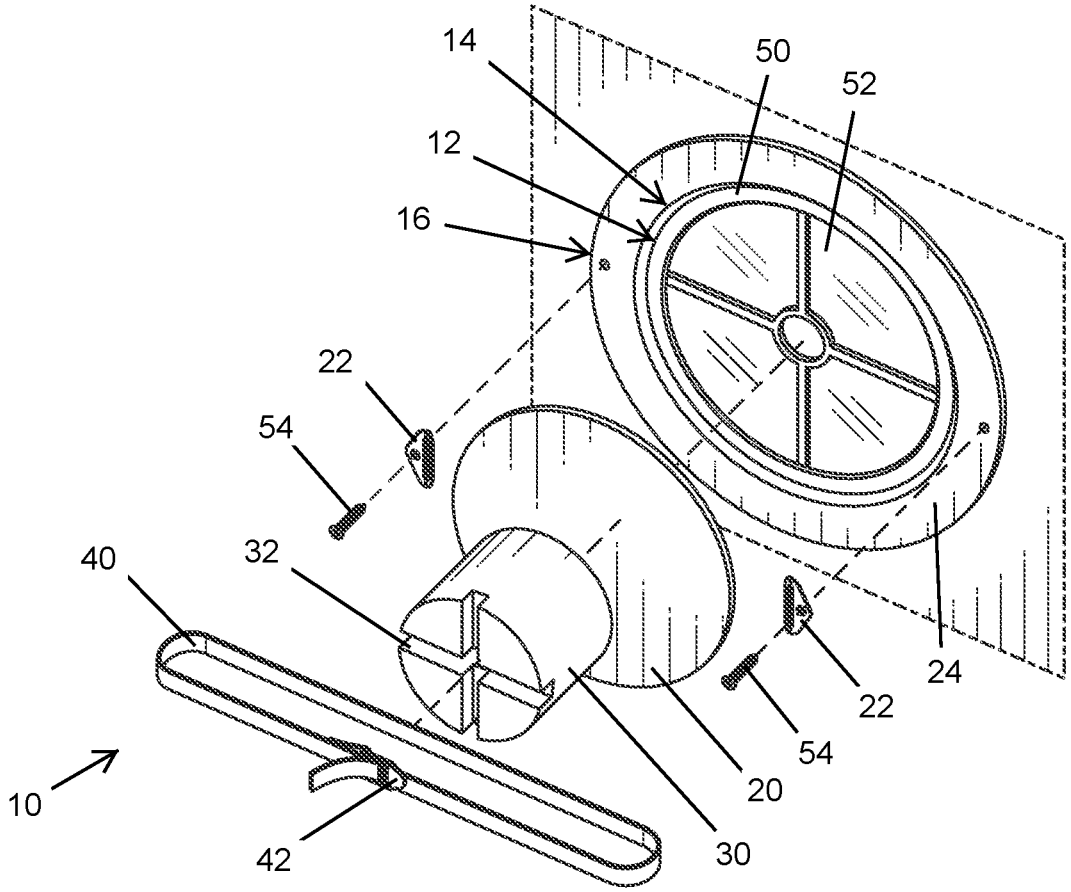
FIG. 1A is a front exploded view of a first example storm protection system of the present disclosure for an example round window.
Figure 1B:
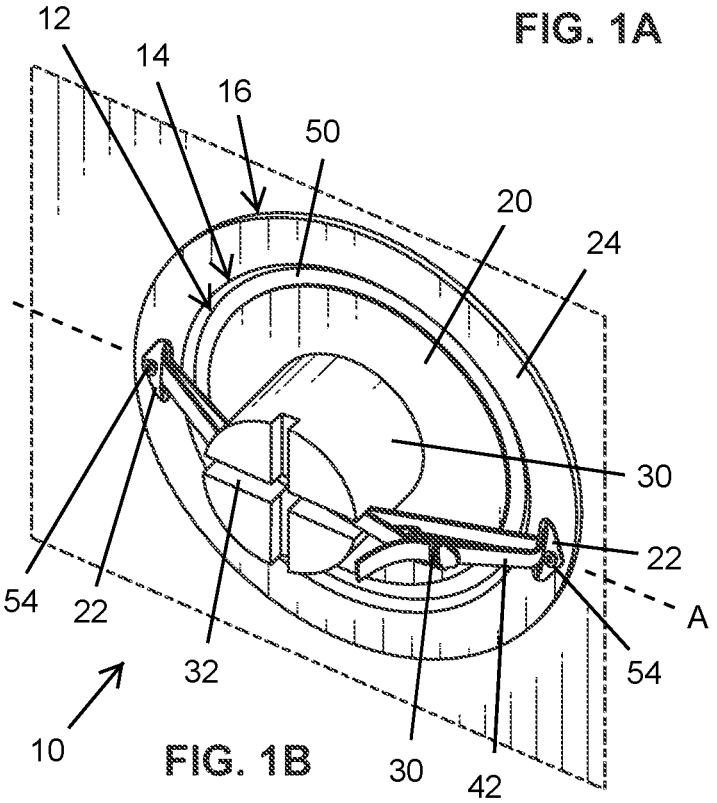
FIG. 1B is a front view of the first example storm protection system of FIG. 1A in an installed position.

The drawing figures illustrate examples of storm protection systems for a window or door unit located in a wall opening. For instance, FIGS. 1A and 1B illustrate a first example storm protection system 10 for a window or door unit 12 located in a wall opening 14 and having an outer frame 16 adjacent the wall opening 14. The storm protection system 10 includes at least one protective panel 20 having generally planar front and rear surfaces and being dimensioned to fit within the outer frame 16 and wall opening 14 while the rear surface contacts the window or door unit 12. At least one pair of brackets 22 are connected to the outer frame 16 at opposing sides of the wall opening 14 located along a first axis A and spaced apart from the front surface of the at least one protective panel a first distance. At least one force distribution body 30 having front and rear surfaces is dimensioned to fit within the outer frame 16 and wall opening 14, with at least one alignment structure 32 on the front surface and being spaced apart from the rear surface a second distance, wherein the rear surface of the at least one force distribution body 30 contacts the front surface of the at least one protective panel 20 and the second distance is greater than the first distance. At least one elongated flexible restraint 40 extends along the first axis A between and is connected to the at least two brackets 22, wherein the at least one elongated flexible restraint 40 is received by the alignment structure 32 on the front surface of the at least one force distribution body 30, and wherein when tensioned the at least one elongated flexible restraint 40 forces the at least one force distribution body 30 against the at least one protective panel 20, which in turn forces the at least one protective panel 20 against the window or door unit 12.

The elongated flexible restraint 40 shown in FIGS. 1A and 1B is constructed of a non-elastic strap, which may be made for example of polyester, polypropylene or other suitable generally non-resilient flexible material, and may be woven or otherwise formed. For strength and ease of handling, the strap may be ½ inch to 1 inch wide, and preferably is ¾ inch wide. A buckle 42 is connected to the elongated flexible restraint 40 and used to temporarily tension the elongated flexible restraint 40 in preparation for and during a storm. The buckle preferably is of a type that permits an elongated flexible restraint 40 to be pulled through and is generally self-locking or resists release without intervention. It also is contemplated that the buckle could be of a type that is not releasable, such that a piece of the elongated flexible restraint would need to be cut to release the storm protection system. In such case, the elongated flexible restraint simply may be replaced. The buckle 42 is of the type shown in FIG. 2A, which may be referred to as being of a closed type of buckle. It will be appreciated that buckles also may be of an open type, such as is shown in the bent wire open type of buckle shown in FIG. 2B, or may be of other suitable types that can maintain tension in an elongated flexible restraint. In FIG. 1B, the elongated flexible restraint 40 is looped through the buckle 42, which is shown with the elongated flexible restraint 40 in an initial stage of being tensioned by being pulled through the buckle 42.

It will be appreciated that buckles that permit an elongated flexible restraint 40 to be looped through brackets 22 and to have both ends pulled through to restrain a force distribution body 30 are particularly advantageous. Such buckles permit a cost-efficient spool of such material to be unwound and quickly and conveniently cut to a desired length, as needed for the elongated flexible restraint 40, without need for accurate measurement. The elongated flexible restraint 40 merely must be able to be received by each bracket 22, such as by looping through or around the bracket, and have its ends pass through the buckle 42 to be tensioned, such as by pulling on the ends of the elongated flexible restraint 40 by hand, or by use of a manual tensioner. Alternatively, the elongated flexible restraint may be constructed with one end connected to a buckle and may have the second end pass through the buckle for tensioning, such as in the form of a ratchet strap or a cam buckle and strap. The materials used for the elongated flexible restraints also may be chosen to be more easily disposed of, such as by recycling, if the elongated flexible restraints become worn.

The force distribution body 30 preferably is relatively tall. For example, it may be 3 inches tall, to permit an alignment structure 32, such as a ¾ inch deep channel in the front surface of the force distribution body 30 to receive the elongated flexible restraint 40 while still permitting a tensioned elongated flexible restraint 40 to generate compressive force to hold the rear surface of the protective panel 20 against the window unit 12. Thus, it is intended that the surface of the force distribution body 30 that the elongated flexible restraint 40 passes over will be spaced from the front of the protective panel 20 a distance that is greater than the relative distance between the brackets 22 and the front of the protective panel 20, thereby causing sort of tenting effect by which the elongated flexible restraint 40 extends at angles rearward from the force distribution body 30 to the brackets 22.

The force distribution body 30 may be formed of various materials and in various configurations, such as a block of closed cell expanded foam, laminated pieces of foam board, a closed molded plastic body, an open molded plastic body, or of other suitable materials and in other suitable forms. The alignment structure 32 on the force distribution body 30 is intended to keep the force distribution body 30 located on the elongated flexible restraint 40. It will be appreciated that the alignment structure may be formed by projections extending forward from the front surface of a force distribution body. Alternatively, as shown in FIGS. 1A-1B, the alignment structure 32 may be formed as a recess or channel 34 in the front surface of the force distribution body 30, which receives the at least one elongated flexible restraint 40. The example force distribution body 30 shown in FIGS. 1A-1B includes two alignment structures in the form of channels, which are perpendicular to each other. While a single channel could be provided, the example force distribution body 30 has the capability of being used in additional applications. Thus, the force distribution body 30 may receive a single elongated flexible restraint extending along one axis, or two elongated flexible restraints extending along two axes that are perpendicular to each other.

The outer frame 16 of the first example storm protection system 10 includes a casing 24 around the wall opening 14.

In this example, the window or door unit 12 is a circular decorative window having a relatively small wall opening 14. The window unit 12 includes at least one perimeter rail 50. The perimeter rail 50 of this example is circular and holds a fixed single or double pane of glass 52. The perimeter rail 50 provides a surface against which the protective panel 20 may be forced by the force distribution body 30 when the elongated flexible restraint 40 is tensioned by use of the buckle 42.

Each bracket 22 is connected to the outer frame 16 by at least one fastener 54. The bracket 22 of this example is separately shown in an enlarged view in FIG. 3A. The bracket 22 is configured to be of a type that has a relatively low-profile including a flat base having an aperture that receives the fastener, and an upward angled extension having a slot that receives the elongated flexible restraint 40 by passing an end of the elongated flexible restraint 40 through the slot. It will be appreciated that other types of brackets may be used, such as the example bracket shown in FIG. 3B, which utilizes two fasteners and provides an inverted U-shape that receives an elongated flexible restraint, or the further example bracket shown in FIG. 3C, which also utilizes two fasteners and provides a lower profile inverted U-shape that receives an elongated flexible restraint by passing the elongated flexible restraint between the bracket and the outer frame. It will be appreciated that for ease of viewing, the sizes of the brackets in the figures are purposefully somewhat enlarged.

Advantageously, the storm protection system 10 requires use of relatively few brackets, which provides an uncluttered appearance. The brackets also require little skill to determine acceptable placement and to install. For instance, the brackets may be installed by use of fasteners 54, which are secured to the casing 24 of the outer frame 16. Each fastener 54 may be, for example, a wood screw preferably made of stainless steel, painted or otherwise having a corrosion resistant coating. Each fastener 54 is of sufficient strength to mount one of the brackets 22 to the outer frame 16 and to maintain tension in the elongated flexible restraint 40 after it has been installed. The brackets 22 need only be installed on opposite sides of the outer frame 16 (such as left and right, or top and bottom) and spaced from the window unit 12 sufficiently to accept the protective panel 20 therebetween. For instance, the brackets 22 may be conveniently spaced and mounted approximately ½ inch forward of the front surface of the protective panel 20.

Ultimately, to generate a compressive force to press the protective panel 20 against the window unit 12 when the elongated flexible restraint 40 is received by the alignment structure 32 on the front surface of the at least one force distribution body 30 and tensioned, the brackets 22 are connected to the outer frame 16 at opposite sides of the wall opening 14 and spaced apart from the front surface of the protective panel 20 a first distance, such as ½ inch, and the force distribution body 30 is dimensioned to fit within the outer frame 16 and wall opening 14 and so that the alignment structure 32 receives the elongated flexible restraint 30 a second distance from the front surface of the protective panel 30, such as 2¼ inches. With the second distance being greater than the first distance, the tensile force in the elongated flexible restraint 30 generates a compressive force toward the protective panel 20. Advantageously, there are virtually no small tolerances required when one merely needs to trap the force distribution body 30 between the elongated flexible restraint 40 and the protective panel 20. This makes the storm protection system 10 particularly well suited for quick and convenient sizing and installation.

It will be appreciated that the protective panel 20 may be constructed using a variety of suitable materials, such as plastic, foamboard, cardboard, fiberboard, wood or metal. The protective panel 20 also preferably is semi-rigid or rigid and may include one or more layers for impact resistance. The at least one protective panel 20 is generally planar, such that it may be relatively flat or may include at least one corrugated layer and FIGS. 4A-4G provide a variety of examples of some of the acceptable materials and configurations for protective panel constructions. These include, for instance, multi-layer clear plastic in FIG. 4A, single layer corrugated translucent plastic in FIG. 4B, plastic-coated foam core board in FIG. 4C, single layer plywood sheet in FIG. 4D, single layer corrugated metal in FIG. 4E, coated multi-layer corrugated cardboard in FIG. 4F, and multi-layer translucent plastic in FIG. 4G. It will be appreciated that these are examples and other materials and configurations may be used.

Protective panel materials that are clear or translucent are advantageous for permitting light to enter the building. Relative to an opaque material, clear and translucent materials reduce the need for an alternative source of light during daylight hours and provide a better sense of the current state of the weather. Given that sheet materials may be in short supply when a storm is approaching, the flexibility to utilize any of several types of materials provides another advantage. In addition, such panels materials may be cut with common power or hand tools and will be easy to lift, handle, stack and stow, as needed.

With the respective components precut, and the brackets 22 already installed, a property owner may very quickly and conveniently complete the installation of a storm protection system 10 when notified of an impending storm. For instance, the ends of elongated flexible restraint 40 may be received by the brackets 22 and joined at a buckle 42, while leaving slack in the elongated flexible restraint 40. The protective panel 20 then may be raised, slipped behind the elongated flexible restraint 40 and into position in the wall opening 14. The protective panel 20 may rest at its bottom within the wall opening 14 and lean outward against the slackened elongated flexible restraint 40, while the force distribution body 30 is retrieved. Then, the force distribution body 30 may be moved into position to have the elongated flexible restraint 40 received within the alignment structure 32 on the face of the force distribution body 30 and the rear of the force distribution body 30 may be positioned against the front surface of the protective panel 20. This takes up much of the slack in the elongated flexible restraint 40, while pushing the protective panel 20 rearward into position against the window unit 12. The elongated flexible restraint 40 then is tensioned, such as by pulling the ends through the buckle 42 until the force distribution body 30 is forced rearward to hold the protective panel 20 in place against the window unit 12. Thus, the storm protection system 10 may be conveniently configured and installed by one person, with relatively little skill required.

Depending on the type of buckle used, a fully installed storm protection system 10 may be removed by first loosening the tension in the elongated flexible restraint 40, such as by manipulating the buckle or by passing an end of the elongated flexible restraint 40 back through the buckle. Alternatively, the elongated flexible restraint 40 may be installed with a fair amount of extra length at one end extending from the buckle. The storm protection system 10 then may be quickly removed by cutting the elongated flexible restraint 40 where the shorter end extends through the buckle. This will leave plenty of length at the opposite end for use in passing both ends of the elongated flexible restraint 40 through the buckle 42 when the time comes to reinstall the storm protection system 10.

It will be appreciated that the general construction of the first example storm protection system may be applied in other configurations. To help demonstrate this, additional examples are shown and described herein.

Figure 3A:
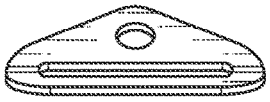
FIG. 3A is a perspective view of a first example bracket that may be used with example storm protection systems of the present disclosure.
Figure 3C:
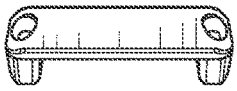
FIG. 3C is a perspective view of a third example bracket that may be used with example storm protection systems of the present disclosure.
Figure 3B:
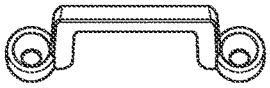
FIG. 3B is a perspective view of a second example bracket that may be used with example storm protection systems of the present disclosure.
Figure 4A:
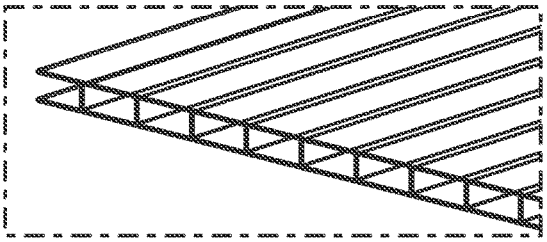
FIG. 4A is a perspective view of a first example protective panel for use with the storm protection systems of the present disclosure and being constructed as a multi-layer clear plastic panel.
Figure 4B:
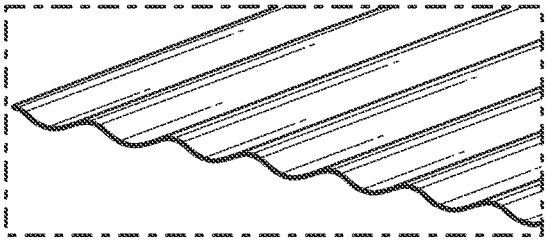
FIG. 4B is a perspective view of a second example protective panel for use with the storm protection systems of the present disclosure and being constructed as a single layer corrugated translucent plastic panel.
Figure 4C:
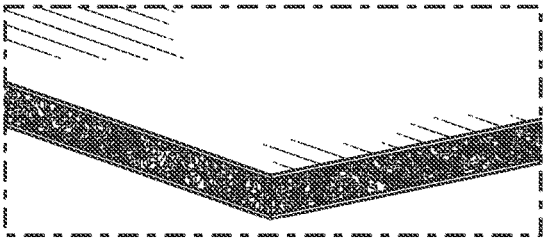
FIG. 4C is a perspective view of a third example protective panel for use with the storm protection systems of the present disclosure and being constructed as a plastic-coated foam core board.
Figure 4D:
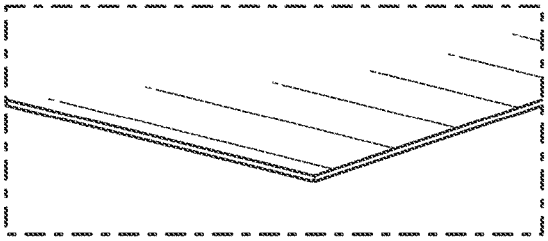
FIG. 4D is a perspective view of a fourth example protective panel for use with the storm protection systems of the present disclosure and being constructed as a single layer sheet of plywood.
Figure 4E:
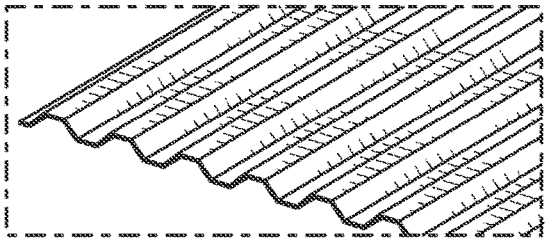
FIG. 4E is a perspective view of a fifth example protective panel for use with the storm protection systems of the present disclosure and being constructed as a single layer corrugated metal panel.
Figure 4F:
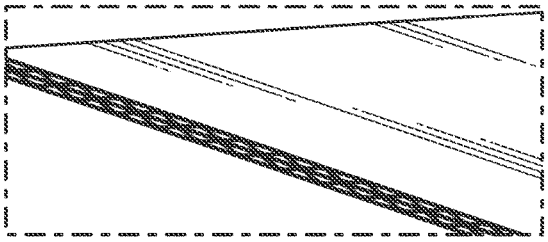
FIG. 4F is a perspective view of a sixth example protective panel for use with the storm protection systems of the present disclosure and being constructed as a coated multi-layer corrugated cardboard panel.
Figure 4G:
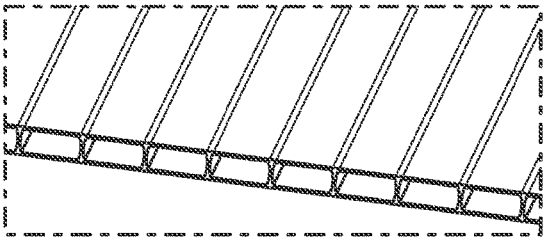
FIG. 4G is a perspective view of a seventh example protective panel for use with the storm protection systems of the present disclosure and being constructed as a multi-layer translucent plastic panel.
Figure 5A:
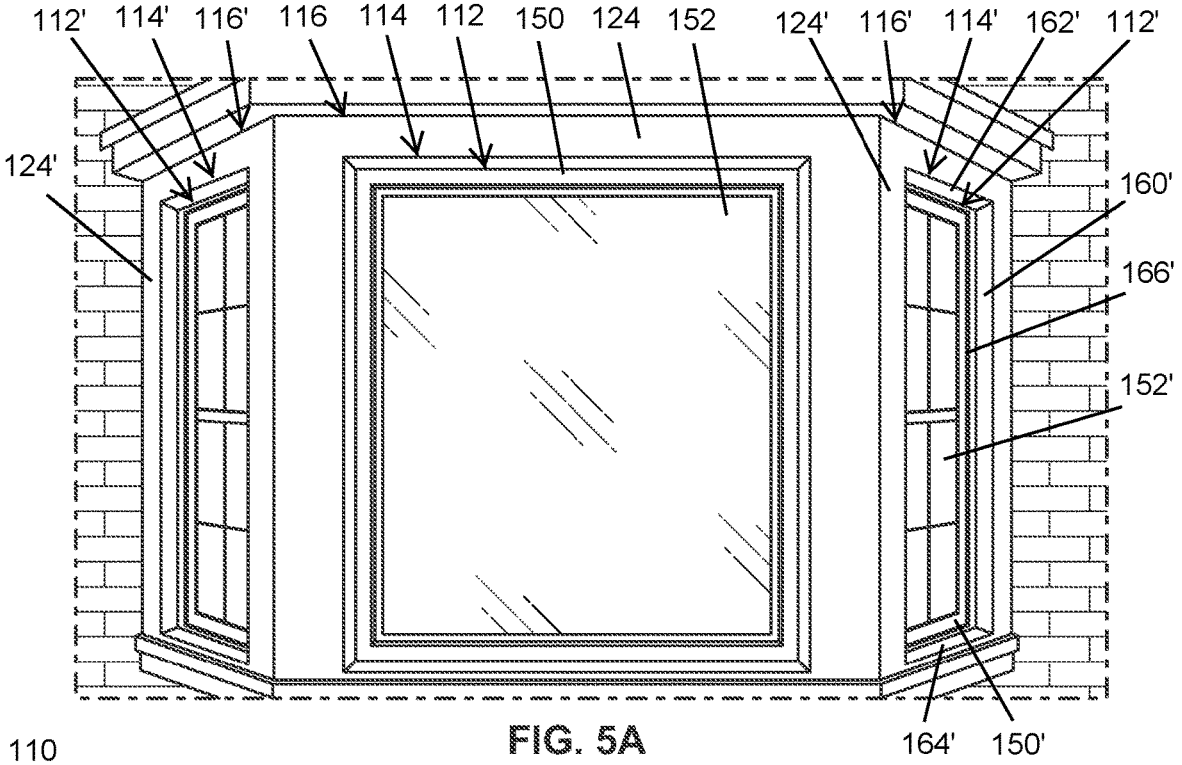
FIG. 5A is a front perspective view of an example bay window arrangement having three adjacent window units in separate wall openings.
Figure 5B:
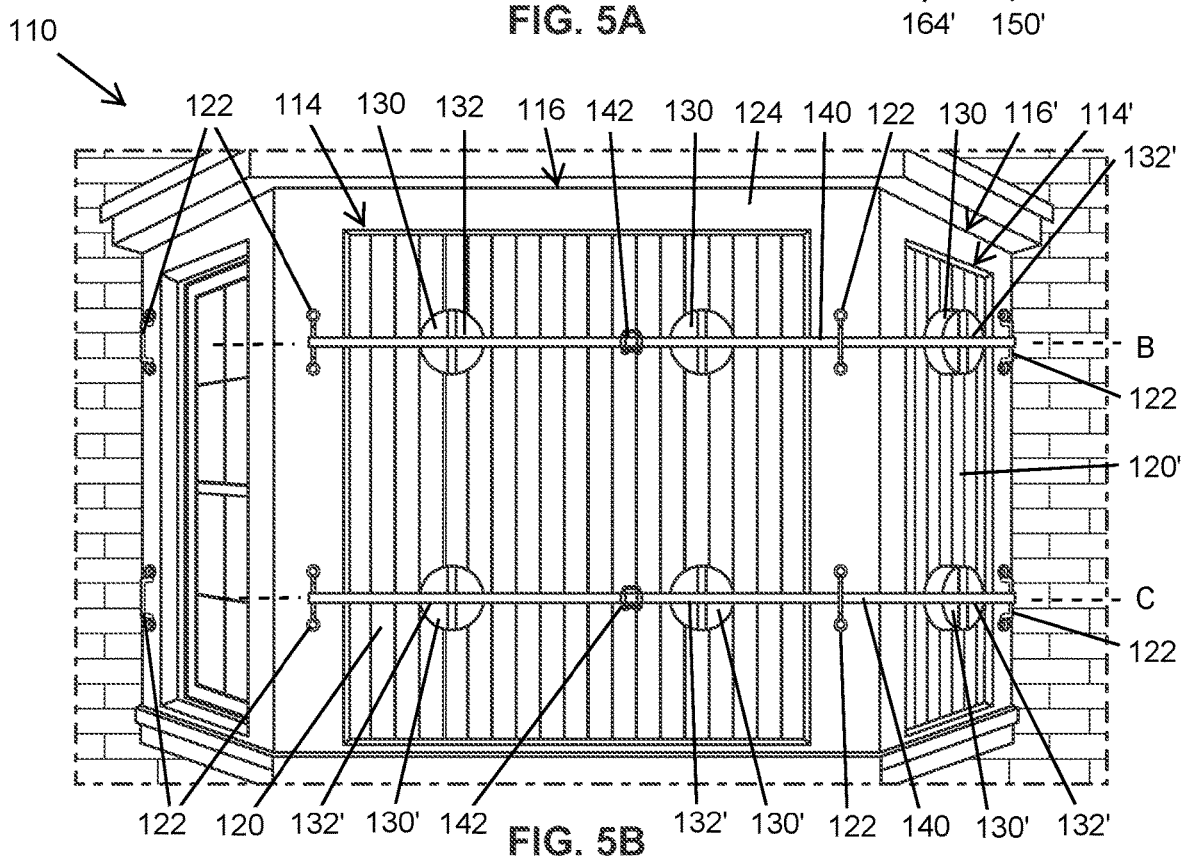
FIG. 5B is a front perspective view of the example bay window arrangement of FIG. 5A having a second example storm protection system of the present disclosure covering two of the three adjacent window units.

Turning to FIGS. 5A and 5B, a further example storm protection system 110 is shown for use with a different window configuration, which may be referred to as a bay window configuration where windows units are spaced apart from a side of a first window. Similarly to the first example shown in FIGS. 1A and 1B, the second example shown in FIGS. 5A and 5B illustrates a storm protection system 110 for a window or door unit 112 located in a wall opening 114 and having an outer frame 116 adjacent the wall opening 114. The storm protection system 110 includes at least one protective panel 120 over the central window unit 112. The protective panel 120 has generally planar front and rear surfaces and is dimensioned to fit within the outer frame 116 and the wall opening 114 while the rear surface contacts the window unit 112. At least one pair of brackets 122 of the type shown in FIG. 3B, is connected to the outer frame 116 at opposing sides of the wall opening 114 and the brackets 122 are spaced apart from the front surface of the protective panels 120 a first distance. At least one force distribution body 130 has front and rear surfaces and is dimensioned to fit within the outer frame 116 and wall opening 114, with at least one alignment structure 132 on the front surface and being spaced apart from the rear surface a second distance, wherein the rear surface of the at least one force distribution body 130, contacts the front surface of the at least one protective panel 120 and the second distance is greater than the first distance. At least one elongated flexible restraint 140 extends along a first axis B between and is connected to the at least two brackets 122 on opposed sides of the wall opening 114, wherein the at least one elongated flexible restraint 140 is received by the alignment structures 132 on the front surface of the force distribution body 130, and wherein when tensioned the at least one elongated flexible restraint 140 forces the respective force distribution body 130 against the protective panel 120, which forces the protective panel 120 against the window unit 112. Thus, the components used in the second example may be quite similar to those used in the first example.

However, the second example shown in FIGS. 5A and 5B has a larger window unit 112 than the window unit 12 of the first example. In turn, this may require additional locations and applications of force against the protective panel 120. For instance, a second force distribution body 130 is positioned along the elongated flexible restraint 140. Thus, the protection system 110 includes a plurality of force distribution bodies 130 having front and rear surfaces and being dimensioned to fit within the outer frame 116 and wall opening 114 along the first axis B of the at least one elongated flexible restraint 140 extending between and connected to the at least two brackets 122, with each force distribution body 130 having at least one alignment structure 132 on the front surface and being spaced apart from the rear surface the second distance, wherein the rear surface of the plurality of force distribution bodies contacts the front surface of the at least one protective panel 120 and the second distance is greater than the first distance. In the second example, the at least one elongated flexible restraint 140 is received by the alignment structure 132 on the front surface of each of the plurality of force distribution bodies 130, and when tensioned, the at least one elongated flexible restraint 140 forces the plurality of force distribution bodies 130 against the at least one protective panel 120 which forces the at least one protective panel 120 against the window or door unit 112.

It will be appreciated that the second example storm protection system 110 also includes a second pair of brackets 122 connected to the outer frame 116 at the opposing sides of the window opening located along a second axis C and spaced apart from the front surface of the at least one protective panel 120 a third distance, wherein the second axis C is parallel to the first axis B. At least one second force distribution body 130' has front and rear surfaces and is dimensioned to fit within the outer frame 116 and wall opening 114 along the second axis C, with at least one alignment structure 132' on the front surface and being spaced apart from the rear surface a fourth distance, wherein the rear surface of the at least one second force distribution body 130' contacts the front surface of the at least one protective panel 120 and the fourth distance is greater than the third distance. A second elongated flexible restraint 140 extends along the second axis C between and connected to the second pair of brackets 122, wherein the second elongated flexible restraint 140 is received by the alignment structure 132' on the front surface of the at least one second force distribution body 130', and wherein when tensioned the second elongated flexible restraint 140 forces the at least one second force distribution body 130' against the at least one protective panel 120 which forces the at least one protective panel 120 against the window or door unit 112. It will be appreciated that in this second example, the second force distribution bodies 130' are identical to the first force distribution bodies 130. Accordingly, the third and fourth distances relating to the second pair of brackets 122 and the alignment structure 132' on the front surface of the at least one second force distribution body 130' are the same as the respective first and second distances associated with the first pair of brackets 122 and the alignment structure 132 on the front surface of the at least one first force distribution body 130.

The different window configuration shown in FIGS. 5A and 5B features a bay window configuration having two narrower window units 112' in respective wall openings 114' spaced from opposed sides of the main or central window unit 112 in the wall opening 114. Each of the window units 112' has an outer frame 116' including a casing 124' that extends around a wall opening 114'. In this example, the storm protection system 110 is employed to protect the central window unit 112 and the righthand window unit 112'. Accordingly, a second protective panel 120' extends over the window unit 112', and advantageously, the elongated flexible restraints 140 extend to a further pair of brackets 122 mounted to the casing 124' to the right of the righthand window unit 112'. Additional force distribution bodies 130' receive the elongated flexible restraints 140 and force the protective panel 120' against the smaller window unit 112'. Thus, the elongated flexible restraints 140 hold in place force distribution bodies 130, 130' and when tensioned the elongated flexible restraints 140 force the force distribution bodies 130, 130' against the respective protective panels 120, 120' which force the protective panels 120, 120' against the respective window units 112, 112'.

Given the rectangular configurations and particular example structures, in addition to the outer frame 116' including a casing 124', the outer frame 116' of the second example shown in FIGS. 5A and 5B includes within the wall opening 114' first opposed sides including left (not shown) and right stiles 160', and second opposed sides including a top header 162' and a bottom sill 164'. The particular window units 112, 112' of this example include respective perimeter rails 150, 150' in rectangular configurations that hold panes of glass 152, 152'. The central window unit 112 is a fixed window, while the narrower side window units 112' are of a double hung configuration. The double hung structure of the side window units 112' permit vertical sliding, which is facilitated by inclusion of jambliner 166' dimensioned to fit within the side wall opening 114' or outer frame 116'.

Figure 2A:
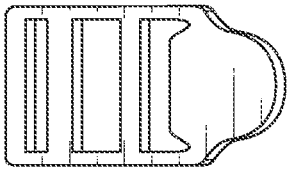
FIG. 2A is a front view of a first example buckle that may be used with example storm protection systems of the present disclosure.
Figure 2B:
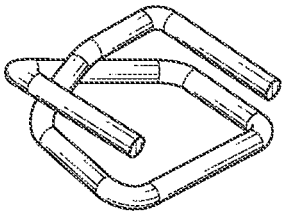
FIG. 2B is a perspective view of a second example buckle that may be used with example storm protection systems of the present disclosure.

In this second example, it also will be appreciated that each bracket 122 is connected to an outer frame 116, 116' by one or more fasteners, which in this case includes two screws that are similar to the fasteners of the first example. The second example shows use of a different buckle 142. Bent wire type buckles 142, as shown in FIG. 2B, are connected to the elongated flexible restraints 140 and each of the elongated flexible restraints 140 includes a substantially non-elastic strap, as described with respect to the first example. Similarly to the above description of the first example, the construction of each of the respective protective panels 120, 120' may include any of the various example materials or constructions previously described, but in the second example, they are shown as being constructed of the material in FIG. 4G, so as to be semi-rigid or rigid multilayer translucent plastic, which may obscure the view of the window. This material advantageously provides light transmission, privacy and enhanced protection. In addition, the respective force distribution bodies 130, 130' may be constructed in accordance with the previous description of optional constructions, but for convenience are shown in a similar manner to the example force distribution body 30 of the first example. It also will be appreciated that for convenience, the respective force distribution bodies 130, 130' may be identical.

Figure 6A:
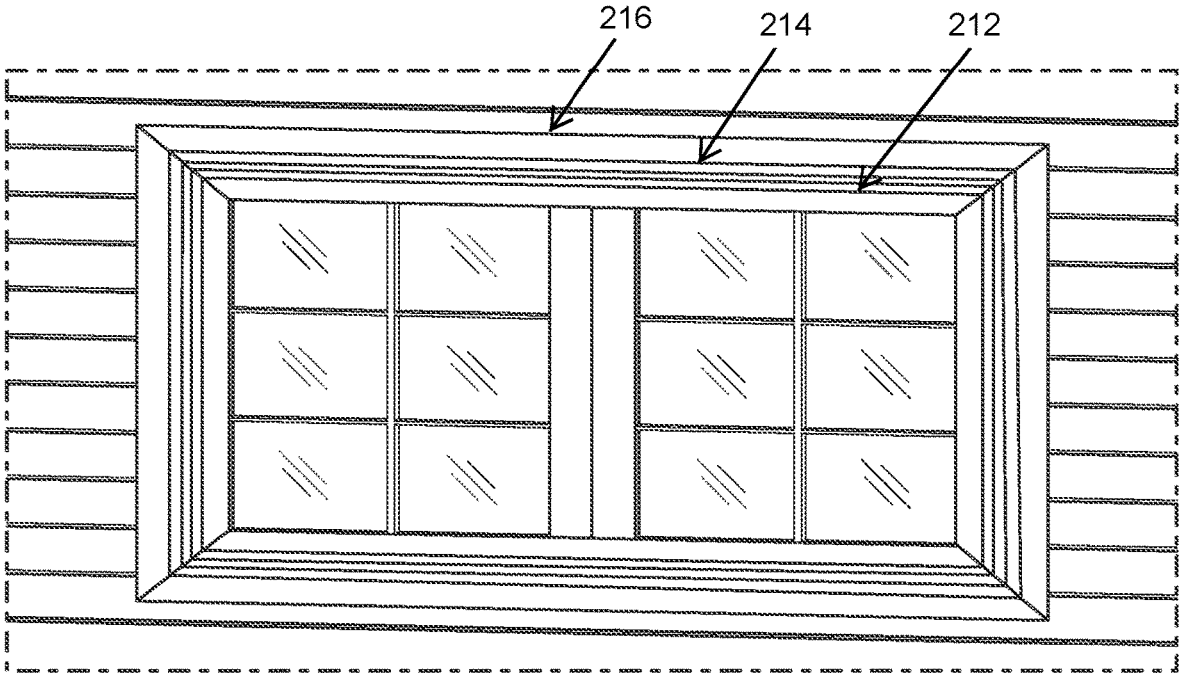
FIG. 6A is a front perspective view of an example dual window arrangement having two adjacent windows of a window unit in a single wall opening.
Figure 6B:
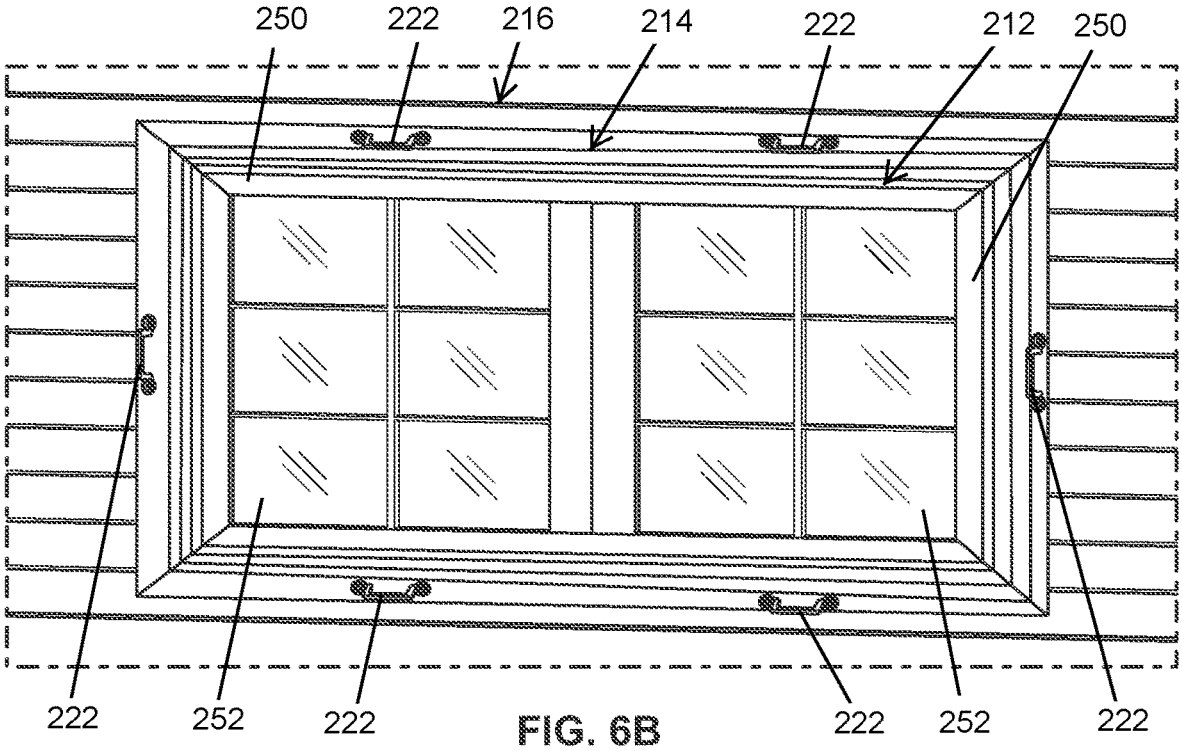
FIG. 6B is a front perspective view of the example dual window arrangement of FIG. 6A having brackets mounted to the outer frame at the wall opening for installation of a storm protection system.
Figure 6C:
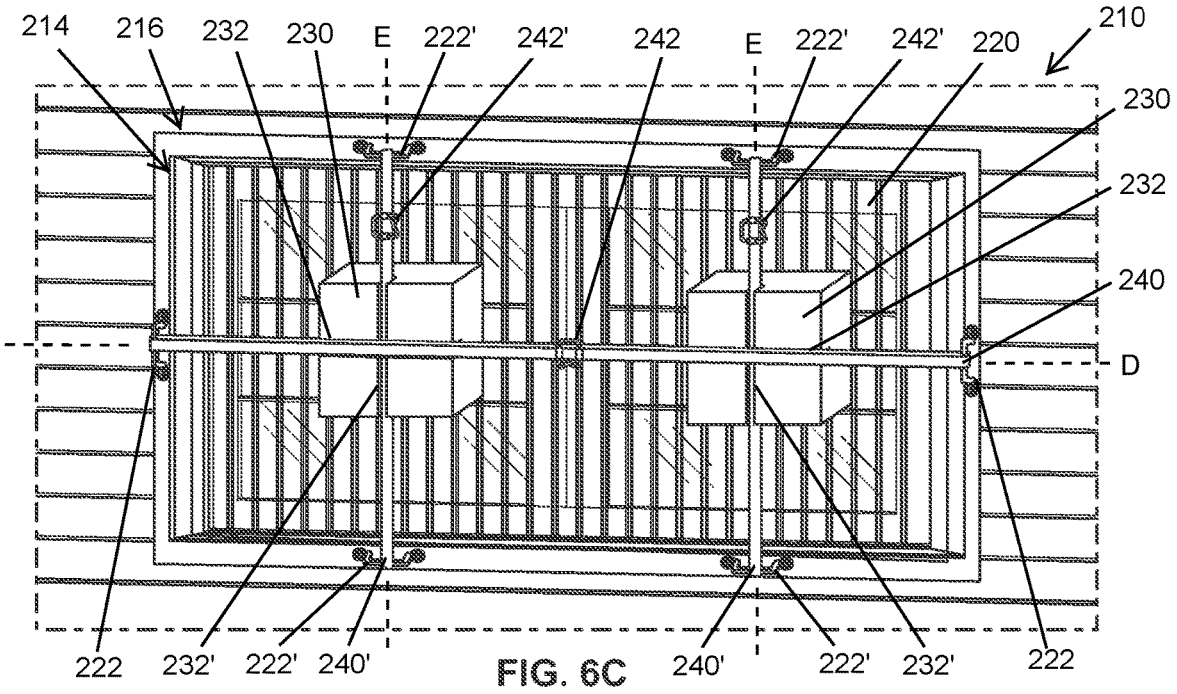
FIG. 6C is a front perspective view of the example dual window arrangement of FIGS. 6A and 6B having a third example storm protection system of the present disclosure covering the two adjacent windows of a window unit.

Turning to FIGS. 6A-6C, another example storm protection system 210 is shown for use with a further different window configuration. Similarly to the previous first and second examples, FIGS. 6A-6C illustrate a storm protection system 210 for a window or door unit 212 located in a wall opening 214 and having an outer frame 216 adjacent the wall opening 214. The storm protection system 210 includes at least one protective panel 220 over the window unit 112. The protective panel 220 has generally planar front and rear surfaces and is dimensioned to fit within the outer frame 216 and the wall opening 214 while the rear surface contacts the window unit 212. At least one pair of brackets 222, similar to the bracket shown in FIG. 3B, is connected to the outer frame 216 at opposing sides of the wall opening 214 and the brackets 222 are spaced apart from the front surface of the protective panels 220 a first distance. At least one force distribution body 230 has front and rear surfaces and is dimensioned to fit within the outer frame 216 and wall opening 214, with at least one alignment structure 232 on the front surface and being spaced apart from the rear surface a second distance, wherein the rear surface of the at least one force distribution body 230, contacts the front surface of the at least one protective panel 220 and the second distance is greater than the first distance. At least one elongated flexible restraint 240 extends along a first axis D between and is connected to the at least two brackets 222 on opposed sides of the wall opening 214, wherein the at least one elongated flexible restraint 240 is received by the alignment structures 232 on the front surface of the force distribution body 230, and wherein when tensioned the at least one elongated flexible restraint 240 forces the respective force distribution body 230 against the protective panel 220, which forces the protective panel 220 against the window unit 212. Thus, the components used in the third example may be quite similar to those used in the first and second examples.

However, the third example shown in FIGS. 6A-6C has a window unit 212 that includes two adjacent windows within one outer frame 216 and wall opening 214. This provides a second window adjacent a side of a first window, resulting in a wider window unit 212. The particular window unit 212 of this example includes respective perimeter rails 250 in rectangular configurations that hold panes of glass 252. It will be appreciated that such a wider structure may require additional locations and applications of force against the single protective panel 220 spanning the wider window unit 212. For instance, a second force distribution body 230 is positioned along the elongated flexible restraint 240. Thus, the protection system 210 includes a plurality of force distribution bodies 230 having front and rear surfaces and being dimensioned to fit within the outer frame 216 and wall opening 214 along the first axis D of the at least one elongated flexible restraint 240 extending between and connected to the at least two brackets 222, with each force distribution body 230 having at least one alignment structure 232 on the front surface and being spaced apart from the rear surface the second distance, wherein the rear surface of the plurality of force distribution bodies 230 contacts the front surface of the at least one protective panel 220 and the second distance is greater than the first distance.

In the third example, the force distribution bodies 230 have a square shape, but otherwise are constructed similarly to the force distribution bodies of the first and second example. The at least one elongated flexible restraint 240 is received by the alignment structure 232 on the front surface of each of the plurality of force distribution bodies 230, and when tensioned using a buckle 242 that is connected to the elongated flexible restraint 240, the temporarily tension in the elongated flexible restraint 240 in preparation for and during a storm forces the plurality of force distribution bodies 230 against the at least one protective panel 220 which forces the at least one protective panel 220 against the window unit 212. It will be appreciated that the buckle 242 is of the bent wire type, shown in FIG. 2B, but may be of other suitable types.

The third example storm protection system 210 differs from the previous examples in that the system includes vertical elongated flexible restraints to provide additional force and stability. For instance, a second pair of brackets 222' are connected to the outer frame 216 at opposing sides of the wall opening 214 located along a second axis E and spaced apart from the front surface of the at least one protective panel 220 a third distance, wherein the second axis E is perpendicular to and crosses the first axis D. As such the at least one force distribution body 230 is positioned along the second axis E and further includes a second alignment structure 232' on the front surface and which is spaced apart from the rear surface a fourth distance, with the fourth distance being greater than the third distance. A second elongated flexible restraint 240' extends along the second axis E between and connected to the second pair of brackets 222'. The second elongated flexible restraint 240' is received by the second alignment structure 232' on the front surface of the at least one force distribution body 230, and wherein when tensioned using a buckle 242' that is connected to the second elongated flexible restraint 240', the second elongated flexible restraint 240' forces the at least one force distribution body 230 against the at least one protective panel 220, which forces the at least one protective panel 220 against the window unit 212. It will be appreciated that in the third example, the third and fourth distances relating to the second pair of brackets 222' and the second alignment structure 232' on the front surface of the at least one force distribution body 230 are the same as the respective first and second distances. It also will be appreciated that the respective brackets 222, 222' may be identical, which also may be the case with the respective force distribution bodies 230, 230' and buckles 242, 242'. Also, the means of tensioning and releasing the tension of the elongated flexible restraints may be similar throughout the example storm protection systems.

Figure 7:
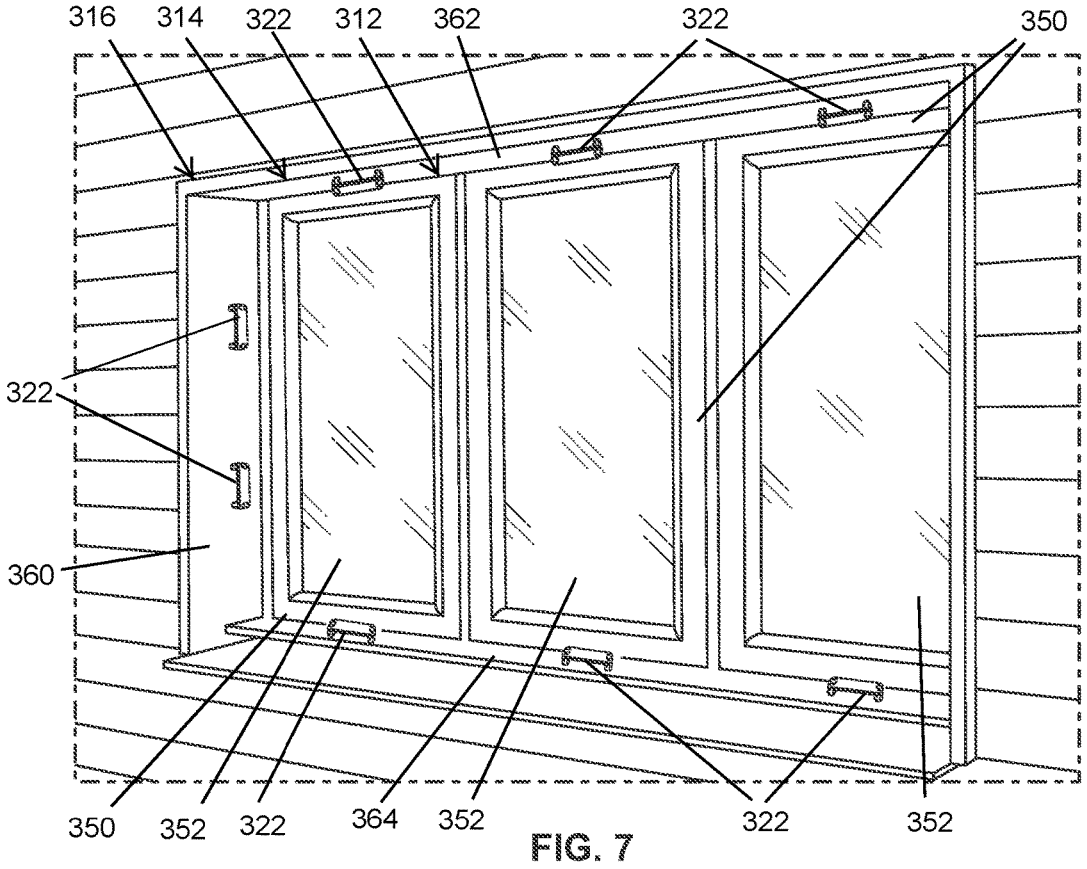
FIG. 7 is a front perspective view of an example window unit having three adjacent windows and having brackets mounted to the outer frame at the wall opening and being ready for installation of the remaining components of a storm protection system including at least one protective panel, a plurality of force distribution bodies and a plurality of elongated flexible restraints, consistent with the present disclosure.

Turning to FIG. 7, a fourth example window configuration is shown with brackets in place for installation of the remainder of a storm protection system. This example window configuration is quite large and includes a window unit 312 having three adjacent windows, side-by-side within one outer frame 316 and wall opening 314. A plurality of pairs of brackets 322 are located on the outer frame 316. The brackets 322 are of the type shown in FIG. 3C, with two brackets 322 installed on a side stile 360, which mirror another two on the opposite side of the outer frame 316 (not shown). Additional brackets 322 are installed along the other sides of the outer frame 316 and wall opening 314, such as three brackets 322 installed along the top header 362 and three brackets 322 installed along the bottom sill 364.

The configuration of mounted brackets 322 shown in FIG. 7 provide for use with two parallel horizontal elongated flexible restraints and three vertical elongated flexible restraints that would be parallel to each other and perpendicular to the horizontal elongated flexible restraints. In turn, the afore-mentioned five elongated flexible restraints would be positioned and capable of restraining and applying force to a total of six force distribution bodies having perpendicularly arranged alignment structures that would receive the respective elongated flexible restraints, with two force distribution bodies vertically aligned on each window. With this level of coverage by force distribution bodies, the storm protection system could utilize either one large protective panel that would cover the panes of glass 352 of all three windows of the window unit, or three smaller protective panels that would rest side-by-side, against the rails 350 of the three individual windows of the respective window unit 312.

Figure 8A:
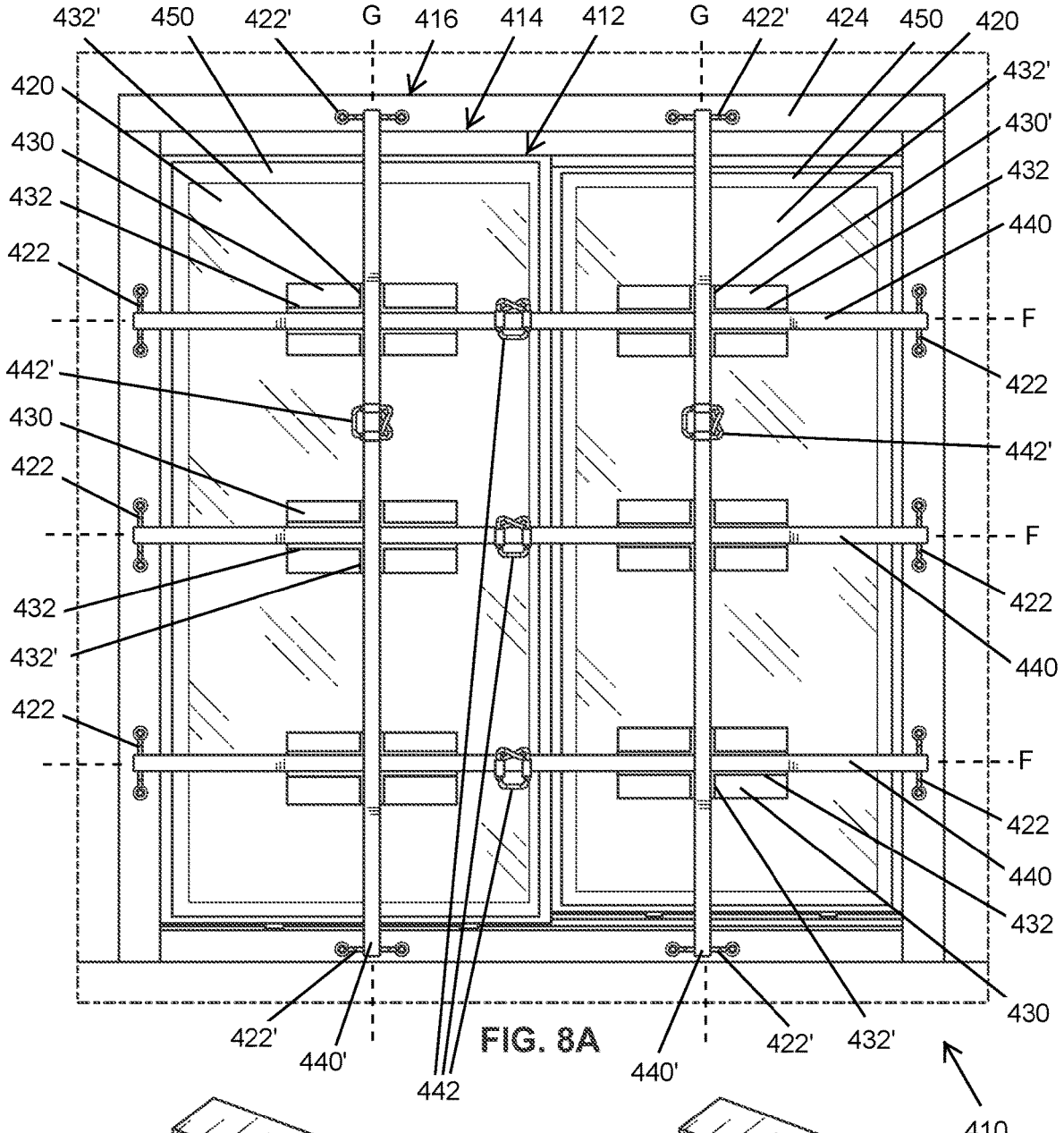
FIG. 8A is a front view of an example patio door unit arrangement having two adjacent doors within an outer frame and a single wall opening, and having a fourth example storm protection system of the present disclosure covering the door unit.
Figure 8B:
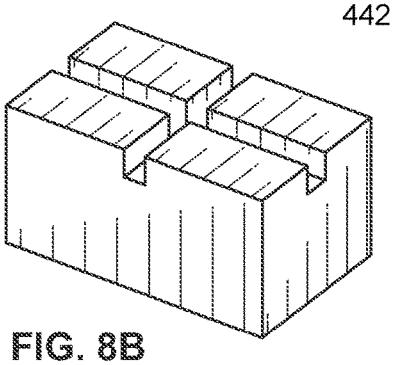
FIG. 8B is a perspective view of an example closed force distribution body used in the fifth example storm protection system shown in FIG. 8A.
Figure 8C:
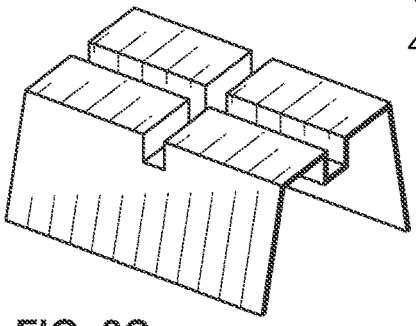
FIG. 8C is a perspective view of an example open force distribution body that is nestably stackable and alternatively may be used, such as in the fifth example storm protection system shown in FIG. 8A.

Turning to FIGS. 8A-8C, a fifth example storm protection system 410 is shown for use with a different window or door configuration. In particular, this example illustrates a sliding patio door unit 412 having two adjacent doors, side-by-side. Similarly to the previous examples, FIG. 8A illustrates a storm protection system 410 for a window or door unit 412 located in a wall opening 414 and having an outer frame 416 adjacent the wall opening 414. The storm protection system 410 includes at least one protective panel 420 over the door unit 412. The protective panel 420 has generally planar front and rear surfaces and is dimensioned to fit within the outer frame 416 and the wall opening 414 while the rear surface contacts the door unit 412. At least one pair of brackets 422, similar to the bracket shown in FIG. 3B, is connected to the outer frame 416 at opposing sides of the wall opening 414, such as at a casing 424 that is adjacent the wall opening 414, and the brackets 422 are spaced apart from the front surface of the protective panels 420 a first distance. At least one force distribution body 430 has front and rear surfaces and is dimensioned to fit within the outer frame 416 and wall opening 414, with at least one alignment structure 432 on the front surface and being spaced apart from the rear surface a second distance, wherein the rear surface of the at least one force distribution body 430, contacts the front surface of the at least one protective panel 420 and the second distance is greater than the first distance. At least one elongated flexible restraint 440 extends along a first axis F between and is connected to the at least two brackets 422 on opposed sides of the wall opening 414, wherein the at least one elongated flexible restraint 440 is received by the alignment structures 432 on the front surface of the force distribution body 430, and wherein when tensioned the at least one elongated flexible restraint 440 forces the respective force distribution body 430 against the protective panel 420, which forces the protective panel 420 against the door unit 412. Thus, the components used in the fifth example may be quite similar to those used in the previous examples.

However, the fifth example shown in FIG. 8A-8B shows a door unit 412 that includes two adjacent doors within one outer frame 416 and wall opening 414. This provides a second door adjacent a side of a first door, resulting in a wider door unit 412 having a significant area of glass. In a common patio door arrangement of this type, one door may be fixed while the other slides, or both doors may slide, but in either instance to utilize a sliding track for at least one door, the doors cannot be literally coplanar. Thus, the two doors must be permitted to overlap each other, with one door further recessed in the wall opening 414 than the other. Due to their size and lack of being coplanar, two individual protective panels 420 are positioned against the rails 450 of the respective doors of the door unit 412. It will be appreciated that such a large structure is susceptible to storm damage and may require additional locations and applications of force against the respective protective panels 420.

For instance, the door unit 412 has a first force distribution body 430 near the top portion of the lefthand door and a second force distribution body 430' is positioned near the top of the righthand door, with both receiving the upper most horizontal elongated flexible restraint 440. Thus, the protection system 410 includes a plurality of force distribution bodies 430, 430' having front and rear surfaces and being dimensioned to fit within the outer frame 416 and wall opening 414 along the first axis F of the at least one elongated flexible restraint 440 extending between and connected to the at least two brackets 422, with each force distribution body 430, 430' having at least one alignment structure 432 on the front surface and being spaced apart from the rear surface the second distance. The rear surface of the plurality of force distribution bodies 430 contact the front surface of the at least one protective panel 420 of the lefthand door and the second protective panel 420, with the second distance being greater than the first distance. When each elongated flexible restraint 440 is tensioned, such as by using a respective buckle 442, the force distribution bodies 430 are forced against the respective protective panels 420, which are forced against the doors of the door unit 412.

In the fifth example, the force distribution bodies 430, 430' have a rectangular shape. They may have different configurations, such as the closed body shown in FIG. 8B, which could be of similar construction to the preceding examples. Alternatively, an open body example force distribution body is shown in FIG. 8C, which may be formed, for example, of molded plastic and configured to be nestably stackable for more convenient storage and shipping. It will be appreciated that other shapes of open body force distribution bodies may be constructed. For instance, the cylindrical force distribution bodies of the first two examples alternatively may be constructed as hollow molded bodies, having an open bottom and a draft angle for the side wall to facilitate nestable stacking. Similarly, the square force distribution bodies of the third example alternatively may be constructed as hollow molded bodies having an open bottom and a draft angle for the side walls to facilitate nestable stacking.

With the fifth example, the force distribution bodies have perpendicular alignment structures 432, 432', in the form of horizontal channels 432 and vertical channels 432' on the front surface of each of the plurality of force distribution bodies 430, 430'. The at least one elongated flexible restraint 440 is received by the alignment structures 432, and when tensioned, the at least one elongated flexible restraint 440 forces the at least one first force distribution body 430 against the at least one lefthand protective panel 420, which forces the at least one lefthand protective panel 420 against the lefthand door of the door unit 412, and the at least one second force distribution body 430' against the at least one righthand protective panel 420, which forces the at least one righthand protective panel 420 against the righthand door of the door unit 412. This pattern is repeated three times with the parallel horizontal elongated flexible restraints 440 connected to brackets 422 on opposed sides of the door unit 412 and with each being received by two force distribution bodies 430, 430' along parallel axes F.

As with the third example storm protection system 210, the fifth example includes vertical elongated flexible restraints 440' to provide additional force and stability. For instance, pairs of second brackets 422' are connected to the outer frame 416 at opposing sides of the door opening 414 located along a second parallel axes G, and spaced apart from the front surface of the respective protective panels 420 a third distance, wherein the second axes G are perpendicular to and crosses the first axes F. As such, the at least one force distribution body 430 is positioned along the second axis G and further includes a second alignment structure 432' on the front surface and which is spaced apart from the rear surface a fourth distance, with the fourth distance being greater than the third distance. A second elongated flexible restraint 440' extends along the second axis G between and connected to the second pair of brackets 422'. The second elongated flexible restraint 440' is received by the second alignment structure 432' on the front surface of the force distribution bodies 430', and wherein when tensioned the second elongated flexible restraint 440' forces the at least one force distribution body 430' against the at least one protective panel 420, which forces the at least one protective panel 420 against the lefthand door of the door unit 412. It will be appreciated that in the fifth example, the third and fourth distances relating to the second pair of brackets 422' and the second alignment structure 432' on the front surface of the at least one force distribution body 430' are the same as the respective first and second distances. It also will be appreciated that the respective brackets 422, 422' may be identical, which also may be the case with the respective force distribution bodies 430, 430'.

Thus, in the fifth example storm protection system 410, five elongated flexible restraints include three parallel horizontal elongated flexible restraints 440 and two parallel vertical elongated flexible restraints 440', which are perpendicular to the horizontal elongated flexible restraints 440. Similarly to the previous examples, the storm protection system 410 may be conveniently installed, removed and stored, by one person, as needed.

In light of the forgoing, it will be appreciated that a storm protection system for a window or door unit located in a wall opening may be provided in various configurations. Any variety of suitable materials of construction, configurations, shapes and sizes for the components and methods of connecting the components may be utilized to meet the particular needs and requirements of an end user. It is to be understood that the invention is not to be limited to the examples disclosed herein, but rather, is intended to cover various modifications and equivalent arrangements included within the spirit and scope of the appended claims. Thus, the description and drawings should be considered illustrative and not restrictive of the invention, which is limited only by the appended claims and their legal equivalents.

The invention claimed is:

1. A storm protection system for a window or door unit located in a wall opening and having an outer frame adjacent the wall opening, the protection system comprising:

at least one protective panel having generally planar front and rear surfaces and being dimensioned to fit within the outer frame and wall opening while the rear surface contacts the window or door unit;

at least one pair of brackets connected to the outer frame at opposing sides of the wall opening located along a first axis and spaced apart from the front surface of the at least one protective panel a first distance;

at least one force distribution body having front and rear surfaces and being dimensioned to fit within the outer frame and wall opening, with at least one alignment structure on the front surface and being spaced apart from the rear surface a second distance, wherein the rear surface of the at least one force distribution body contacts the front surface of the at least one protective panel and the second distance is greater than the first distance;

at least one elongated flexible restraint extending along the first axis between and connected to the at least two brackets, wherein the at least one elongated flexible restraint is received by the at least one alignment structure on the front surface of the at least one force distribution body, and wherein when tensioned the at least one elongated flexible restraint forces the at least one force distribution body against the at least one protective panel which forces the at least one protective panel against the window or door unit.

2. The storm protection system of claim 1, wherein the outer frame further comprises within the wall opening first opposed sides including left and right stiles, and second opposed sides including a top header and a bottom sill.

3. The storm protection system of claim 2, wherein the outer frame further comprises a casing around the wall opening.

4. The storm protection system of claim 1, wherein the outer frame comprises a casing around the wall opening.

5. The storm protection system of claim 1, wherein the window or door unit comprises at least one perimeter rail.

6. The storm protection system of claim 1, wherein the window or door unit comprises a jambliner dimensioned to fit within the wall opening or outer frame.

7. The storm protection system of claim 1, wherein each bracket is connected to the outer frame by one or more fasteners.

8. The storm protection system of claim 1, further comprising a buckle releasably connected to the at least one elongated flexible restraint.

9. The storm protection system of claim 1, wherein the at least one elongated flexible restraint further comprises a substantially non-elastic strap.

10. The storm protection system of claim 1, wherein the at least one protective panel comprises plastic, foamboard, cardboard, fiberboard, wood or metal.

11. The storm protection system of claim 1, wherein the at least one protective panel is semi-rigid or rigid and comprises one or more layers.

12. The storm protection system of claim 1, wherein the at least one protective panel comprises at least one corrugated layer.

13. The storm protection system of claim 1, wherein the at least one force distribution body comprises expanded foam, foamboard, cardboard, fiberboard, plastic, wood or metal.

14. The storm protection system of claim 1, wherein the alignment structure on the at least one force distribution body comprises a channel that receives the at least one elongated flexible restraint.

15. The storm protection system of claim 1, further comprising a plurality of force distribution bodies having front and rear surfaces and being dimensioned to fit within the outer frame and wall opening along the first axis of the at least one elongated flexible restraint extending between and connected to the at least two brackets, with each force distribution body having at least one alignment structure on the front surface and being spaced apart from the rear surface the second distance;

wherein the rear surface of the plurality of force distribution bodies contacts the front surface of the at least one protective panel and the second distance is greater than the first distance;

wherein the at least one elongated flexible restraint is received by the alignment structure on the front surface of each of the plurality of force distribution bodies, and wherein when tensioned the at least one elongated flexible restraint forces the plurality of force distribution bodies against the at least one protective panel which forces the at least one protective panel against the window or door unit.

16. The storm protection system of claim 1, further comprising a second pair of brackets connected to the outer frame at the opposing sides of the window opening located along a second axis and spaced apart from the front surface of the at least one protective panel a third distance, wherein the second axis is parallel to the first axis;

at least one second force distribution body having front and rear surfaces and being dimensioned to fit within the outer frame and wall opening along the second axis, with at least one alignment structure on the front surface and being spaced apart from the rear surface a fourth distance;

wherein the rear surface of the at least one second force distribution body contacts the front surface of the at least one protective panel and the fourth distance is greater than the third distance;

a second elongated flexible restraint extending along the second axis between and connected to the second pair of brackets, wherein the second elongated flexible restraint is received by the alignment structure on the front surface of the at least one second force distribution body, and wherein when tensioned the second elongated flexible restraint forces the at least one second force distribution body against the at least one protective panel which forces the at least one protective panel against the window or door unit.

17. The storm protection system of claim 16, wherein the third and fourth distances relating to the second pair of brackets and the alignment structure on the front surface of the at least one second force distribution body are the same as the respective first and second distances.

18. The storm protection system of claim 1, further comprising a second pair of brackets connected to the outer frame at opposing sides of the window opening located along a second axis and spaced apart from the front surface of the at least one protective panel a third distance, wherein the second axis is perpendicular to and crosses the first axis;

wherein the at least one force distribution body is positioned along the second axis and further comprises a second alignment structure on the front surface and being spaced apart from the rear surface a fourth distance, with the fourth distance being greater than the third distance;

a second elongated flexible restraint extending along the second axis between and connected to the second pair of brackets, wherein the second elongated flexible restraint is received by the second alignment structure on the front surface of the at least one force distribution body, and wherein when tensioned the second elongated flexible restraint forces the at least one force distribution body against the at least one protective panel which forces the at least one protective panel against the window or door unit.

19. The storm protection system of claim 18, wherein the third and fourth distances relating to the second pair of brackets and the second alignment structure on the front surface of the at least one force distribution body are the same as the respective first and second distances.

20. The storm protection system of claim 1, wherein the window or door unit includes a second window or door adjacent or spaced apart from a side of a first window or door.

* * * * *